US006296745B1

(12) United States Patent
DuBois et al.

(10) Patent No.: US 6,296,745 B1
(45) Date of Patent: Oct. 2, 2001

(54) METHOD OF OPERATING CHLOR-ALKALI ELECTROLYTIC CELLS

(75) Inventors: Donald W. DuBois, Irwin; Bernard A. Maloney, Murrysville, both of PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 09/560,598

(22) Filed: Apr. 28, 2000

(51) Int. Cl.[7] ..... C25C 7/06

(52) U.S. Cl. ..... 204/266; 204/252; 204/263; 205/510; 205/512

(58) Field of Search ..... 204/252

(56) References Cited

U.S. PATENT DOCUMENTS

| | | | |
|---|---|---|---|
| 3,980,547 | 9/1976 | Kunkle | 204/301 |
| 4,003,811 | 1/1977 | Kunkle | 204/180 R |
| 4,048,038 | 9/1977 | Kunkle | 204/180 R |
| 4,110,189 | 8/1978 | Kunkle et al. | 204/180 R |
| 4,132,626 | 1/1979 | Kunkle | 204/301 |
| 4,339,313 | 7/1982 | Rechlicz | 204/98 |
| 4,354,900 | 10/1982 | Bailey et al. | 162/106 |
| 4,680,101 | 7/1987 | Darlington et al. | 204/295 |
| 5,030,403 | 7/1991 | Pickens et al. | 264/140 |
| 5,092,977 | 3/1992 | Bachot et al. | 204/252 |
| 5,188,712 | 2/1993 | Dilmore et al. | 204/98 |
| 5,320,867 | 6/1994 | Bachot et al. | 427/226 |
| 5,470,449 | 11/1995 | Bachot et al. | 204/252 |
| 5,567,298 | 10/1996 | DuBois et al. | 205/350 |
| 5,630,930 | 5/1997 | Maloney | 205/350 |
| 6,059,944 | 5/2000 | DuBois et al. | 204/296 |

*Primary Examiner*—Bruce F. Bell
(74) *Attorney, Agent, or Firm*—Dennis G. Millman; James R. Franks

(57) ABSTRACT

A method of operating a chlor-alkali electrolytic cell comprising a catholyte compartment containing a cathode, an anolyte compartment containing an anode, and a liquid-permeable diaphragm partitioning the catholyte and anolyte compartments, is described. The method comprises adding water-insoluble inorganic particulate material, e.g., clay mineral, and alkali metal polyphosphate, e.g., tetrasodium pyrophosphate, to the anolyte compartment of the electrolytic cell while the cell is operating. The water-insoluble inorganic particulate material and alkali metal polyphosphate may be added to the anolyte compartment in the form of an aqueous slurry.

22 Claims, No Drawings

METHOD OF OPERATING CHLOR-ALKALI ELECTROLYTIC CELLS

DESCRIPTION OF THE INVENTION

The present invention relates to an improved method of operating a chlor-alkali electrolytic cell. In particular the present invention relates to a method of operating a chlor-alkali cell in which water-insoluble inorganic particulate material and alkali metal-polyphosphate are added to the anolyte compartment of the electrolytic cell during operation of the cell.

The electrolysis of alkali metal halide brines, such as sodium chloride and potassium chloride brines, in electrolytic cells is a well known commercial process. Electrolysis of such brines results in the production of halogen, hydrogen and aqueous alkali metal hydroxide. In the case of sodium chloride brines, the halogen produced is chlorine and the alkali metal hydroxide is sodium hydroxide. The electrolytic cell typically comprises an anolyte compartment containing an anode, and a separate catholyte compartment containing a cathode. The electrolytic cell typically further comprises a liquid-permeable diaphragm, which partitions the electrolytic cell into the separate anolyte and catholyte compartments.

The electrolysis of brine typically involves charging an aqueous solution of the alkali metal halide salt, e.g., sodium chloride brine, to the anolyte compartment of the cell. The aqueous brine percolates through the liquid permeable diaphragm into the catholyte compartment and then exits from the cell. With the application of direct current electricity to the cell, halogen gas, e.g., chlorine gas, is evolved at the anode, hydrogen gas is evolved at the cathode and aqueous alkali metal hydroxide is formed in the catholyte compartment from the combination of alkali metal ions with hydroxyl ions.

For the cell to operate properly it is required that the diaphragm, which partitions the anolyte and catholyte compartments, be sufficiently porous to allow the hydrodynamic flow of brine through it, while at the same time inhibiting the back migration of hydroxyl ions from the catholyte compartment into the anolyte compartment. The diaphragm should also (a) inhibit the mixing of evolved hydrogen and chlorine gases, which can pose an explosive hazard, and (b) possess low electrical resistance, i.e., have a low IR drop.

During the operation of a chlor-alkali cell, the porosity of the diaphragm typically increases resulting in, for example, reduced current efficiency, the production of overly dilute alkali metal hydroxide, the back migration of hydroxyl ions from the catholyte compartment into the anolyte compartment, and an increased risk of the mixing of evolved hydrogen and chlorine gases. To adjust and optimize the porosity of the diaphragm, inorganic particulate materials, such as clay minerals, are typically added periodically to the anolyte compartment during operation of the cell.

U.S. Pat. No. 5,567,298 describes a method of making chlorine and alkali metal hydroxide in an electrolytic cell of the type wherein a liquid permeable asbestos-free diaphragm separates the catholyte and anolyte compartments. The '298 patent describes increasing the current efficiency of the cell by the sequential steps of (a) adding clay mineral to the anolyte compartment of the cell, (b) lowering the pH of the anolyte by the addition of an inorganic acid, and (c) maintaining the anolyte at the lowered pH for a time sufficient to restore the cell to a predetermined current efficiency.

U.S. Pat. Nos. 3,980,547, 4,003,811, 4,048,038, 4,110,189 and 4,132,189 describe the electrokinetic separation of clay particles from an aqueous suspension of clay particles. The suspension of clay particles is described in the '547, '811, '038, U.S. Pat. Nos. 4,110,189 and 4,132,189 patents as being formed by dispersing clay particles in water with tetrasodium pyrophosphate.

It would be desirable to develop improved methods of operating electrolytic cells used for the production of chlorine and alkali metal hydroxide, i.e., chlor-alkali electrolytic cells. In particular, it would be desirable to develop improved methods of increasing the current efficiency of a chlor-alkali cell during its operation.

In accordance with the present invention there is provided a method of operating an electrolytic cell, said method comprising:

(a) providing an electrolytic cell having a catholyte compartment containing a cathode, an anolyte compartment containing an anode, and a liquid-permeable diaphragm separating said catholyte and anolyte compartments;

(b) introducing alkali metal chloride brine into said anolyte compartment;

(c) applying an electrical potential across said cathode and anode;

(d) withdrawing hydrogen gas and an aqueous solution comprising alkali metal hydroxide from said catholyte compartment, and chlorine gas from said anolyte compartment; and (e) adding water-insoluble inorganic particulate material and alkali metal polyphosphate to said anolyte compartment while said electrolytic cell is operating, thereby increasing the current efficiency of said electrolytic cell.

Other than in the operating examples, or where otherwise indicated, all numbers or expressions referring to quantities of ingredients, reaction conditions, etc. used in the specification and claims are to be understood as modified in all instances by the term "about."

DETAILED DESCRIPTION OF THE INVENTION

The water-insoluble inorganic particulate material that is added to the anolyte compartment in the method of the present invention is typically selected from valve metal oxides, valve metal silicates, clay minerals and mixtures thereof. As used herein and in the claims, the term "valve metal" is meant to be inclusive of vanadium, chromium, zirconium, niobium, molybdenum, hafnium, tantalum, titanium, tungsten and mixtures thereof. Of the valve metals, titanium and zirconium are preferred in the present invention. Of the valve metal oxides and valve metal silicates, valve metal oxides are preferred, e.g., titanium dioxide and zirconium oxide.

Clay minerals that may be added to the anolyte compartment in the method of the present invention include those that are naturally occurring hydrated silicates of metals, such as aluminum and magnesium, e.g., kaolin, meerschaums, augite, talc, vermiculite, wollastonite, montmorillonite, illite, glauconite, attapulgite, sepiolite and hectorite. Of the clay minerals, attapulgite and hectorite and mixtures thereof are preferred for use in the method of the present invention. Such preferred clays are hydrated magnesium silicates and magnesium aluminum silicates, which may also be prepared synthetically.

The mean particle size of the water-insoluble inorganic particulate material that is added to the anolyte compartment may vary, but is typically in the range of from 0.1 microns to 20 microns, e.g., from 0.1 microns to 0.5 microns. In an embodiment of the present invention, the water-insoluble inorganic particulate material is an attapulgite clay. An attapulgite clay product having a mean particle size of about 0.1 microns and available from Engelhard Corporation under the trademark, "ATTAGEL®" has been found to be particularly useful in the practice of the method of the present invention.

The water-insoluble inorganic particulate material is typically added to the anolyte compartment in an amount sufficient to provide the desired diaphragm permeability and current efficiency. The amount of inorganic particulate material added may vary depending on, for example, electrolytic cell operating characteristics, cell geometry and cell capacity. Typically, water-insoluble inorganic particulate material is added to the anolyte compartment in an amount of from 10 grams to 120 grams per square meter of diaphragm surface area, e.g., from 20 grams to 60 grams per square meter of diaphragm surface area. As used herein and in the claims, the "diaphragm surface area" is calculated from the dimensions of the diaphragm, for example, a 10 cm×10 cm diaphragm has a calculated surface area of 100 square centimeters ($cm^2$).

The alkali metal polyphosphate that is added to the anolyte compartment in the method of the present invention may be represented by the following general formula I, $$M_{e+2}P_eO_{3e+1}.fH_2O \qquad \text{I}$$

in which M is the alkali metal and may be selected from lithium, sodium, potassium, rubidium, cesium, francium and mixtures thereof; e is at least 2 (e.g., a number from 2 to 100, 2 to 10 or 2 to 5); and f is greater than or equal to 0 (e.g., 0, a number from 1 to 20 or from 1 to 10). More typically, the alkali metal of the alkali metal polyphosphate is selected from sodium, potassium and mixtures thereof. As used herein and in the claims, the term "alkali metal polyphosphate" refers to dehydrated alkali metal polyphosphates, hydrated alkali metal polyphosphates and mixtures of dehydrated and hydrated alkali metal polyphosphates.

Classes of alkali-metal polyphosphates that may be used in the method of the present invention include, but are not limited to, tetraalkali metal pyrophosphate (e.g., tetrasodium pyrophosphate and tetrapotassium pyrophosphate), alkali metal triphosphate (e.g., sodium triphosphate and potassium triphosphate), alkali metal tetraphosphate (e.g., sodium tetraphosphate), alkali metal hexametaphosphate (e.g., sodium hexametaphosphate) and mixtures thereof. In a preferred embodiment of the present invention the alkali metal polyphosphate is selected from tetraalkali metal pyrophosphate. Preferred tetraalkali metal pyrophosphates include dehydrated tetrasodium pyrophosphate, hydrated tetrasodium pyrophosphate (e.g., tetrasodium pyrophosphate decahydrate), and mixtures of dehydrated and hydrated tetrasodium pyrophosphates.

Alkali metal polyphosphate is typically added to the anolyte compartment in an amount of from 1 gram to 60 grams per square meter of diaphragm surface area, e.g., from 5 grams to 15 grams per square meter of diaphragm surface area. The weight ratio of water-insoluble inorganic particulate material to alkali metal polyphosphate added to the anolyte compartment may vary, e.g., from 0.1:1 to 120:1. Typically, the weight ratio of water-insoluble inorganic particulate material to alkali metal polyphosphate that is added to the anolyte compartment is from 0.5:1 to 5:1, e.g., 1:1.

In an embodiment of the present invention, the water-insoluble inorganic particulate material and alkali metal polyphosphate are premixed together with an aqueous medium to form an aqueous doping slurry or suspension, which is then added to the anolyte compartment. The aqueous doping slurry may be prepared by methods that are known to the skilled artisan. While the doping slurry may be prepared by energy intensive methods, e.g., using a high energy mixer or Cowles blade, the doping slurry is typically prepared by relatively low energy intensive methods, e.g., by means of an impeller or magnetic stir bar.

The doping slurry may contain water-insoluble inorganic material and alkali metal polyphosphate in a wide range of concentrations, e.g., from 0.1 percent by weight to 10 percent by weight of a combination of water-insoluble inorganic material and alkali metal polyphosphate, based on the total weight of the doping slurry. Typically, the doping slurry contains a low concentration of water-insoluble inorganic material and alkali metal polyphosphate, for example, less than 10 percent by weight of a combination of inorganic material and alkali metal polyphosphate, based on the total weight of the doping slurry. More typically, the doping slurry contains less than 5 percent by weight of a combination of inorganic material and alkali metal polyphosphate, based on the total weight of the doping slurry, e.g., from 0.5 to 1 percent by weight of a combination of inorganic material and alkali metal polyphosphate, based on the total weight of the doping slurry.

The aqueous medium of the doping slurry may comprise alkali metal chloride, e.g., sodium chloride. The amount of alkali metal chloride that may be present in the aqueous medium of the doping slurry is generally equal to or less than the amount of alkali metal chloride that is present in the anolyte of the anolyte compartment, e.g., less than or equal to 25 percent by weight alkali metal chloride, based on the total weight of the aqueous medium of the doping slurry.

The doping slurry may be added to the anolyte compartment at a temperature ranging, for example, from 25° C. to the temperature of the anolyte within the anolyte compartment (e.g., 90° C.). Typically, the doping slurry is added to the anolyte compartment at ambient temperature, e.g., 25° C.

Electrolytic cells operated in accordance with the method of the present invention typically have a pressure gradient across the diaphragm. Typically, the pressure gradient across the diaphragm is the result of a hydrostatic head on the anolyte side of the diaphragm, i.e., the liquid level in the anolyte compartment will be on the order of from about 1 to about 25 inches (2.54–63.5 cm) higher than the liquid level of the catholyte compartment. The specific flow rate of electrolyte through the diaphragm may vary with the type of cell, and how it is used. In a chlor-alkali cell operated in accordance with the method of the present invention, the diaphragm should be able to pass from about 0.001 to about 0.5 cubic centimeters of anolyte per minute per square centimeter of diaphragm surface area. The flow rate is generally set at a rate that allows production of a predetermined, targeted alkali metal hydroxide concentration, e.g., sodium hydroxide concentration, in the catholyte, and the level differential between the anolyte and catholyte compartments is then related to the porosity of the diaphragm and the tortuosity of the pores.

While not intending to be bound by any theory, it is believed, based on the evidence at hand, that the addition of water-insoluble inorganic particulate material and alkali metal polyphosphate to the anolyte compartment in the present invention results in limiting the porosity of the diaphragm, and correspondingly increases the current efficiency of the cell. The frequency with which the inorganic particulate material and alkali metal polyphosphate are added to the anolyte compartment in the present invention can be related to the difference between the liquid level of the anolyte and catholyte compartments. For example, when the difference between the liquid levels of the anolyte and catholyte compartments is observed to drop or reside below a certain level, e.g., 9 inches (23 cm), an addition of inorganic particulate material and alkali metal polyphosphate can be made to the anolyte compartment.

While the method of the present invention is inclusive of continuous additions of inorganic particulate material and alkali metal polyphosphate to the anolyte compartment, the inorganic particulate material and alkali metal polyphosphate are more typically added periodically to the anolyte compartment. Inorganic particulate material and alkali metal polyphosphate are typically added to the anolyte compartment (in amounts as recited previously herein) at a frequency of from once per hour to once per 48 hours of continuous cell operation, and more typically from once per 24 hours to once per week of continuous cell operation.

As used herein and in the claims, the "current efficiency" of the electrolytic cell is equivalent to the "caustic efficiency" of the cell, which is calculated by comparing the amount of alkali metal hydroxide collected over a given period of time with the theoretical amount of alkali metal hydroxide that would have been generated according to Faraday's Law. The current efficiency of an electrolytic cell operated according to the method of the present can vary widely, e.g., from 50 percent to 99 percent efficiency. Typically, the current efficiency of a cell operated in accordance with the present invention is at least 80 percent, preferably at least 90 percent, and more preferably at least 95 percent. In addition to increasing the current efficiency of the electrolytic cell, the scope of the present invention is also inclusive of maintaining the current efficiency of the cell at or above a predetermined value, e.g., 95 percent current efficiency.

The liquid-permeable diaphragm of the electrolytic cell may be of any material or combination of materials known in the chlor-alkali art, and can be prepared by techniques known to the skilled artisan. Diaphragms that are used in chlor-alkali cells are typically made substantially of fibrous material(s), such as traditionally used asbestos fibers and more recently plastic fibers, such as polytetrafluoroethylene. Such diaphragms are typically prepared by vacuum deposition of the diaphragm material from a liquid slurry onto a permeable substrate, e.g., a foraminous cathode. After deposition onto the permeable substrate, the diaphragm is typically dried at a suitable temperature and in a manner known to those skilled in the chlor-alkali art. The diaphragm material may be vacuum deposited and formed directly on the cathode, or it may be formed on a permeable substrate from which the diaphragm may be separated.

In an embodiment of the present invention, the liquid-permeable diaphragm is a liquid-permeable asbestos-free diaphragm comprising (a) a base mat of asbestos-free material comprising fibrous synthetic polymeric material resistant to the environment of the electrolytic cell, and (b) a topcoat comprising at least one oxide or silicate of a valve metal formed on and within the diaphragm.

The topcoat of the asbestos-free diaphragm is typically formed on and within the base mat by drawing through the base mat a liquid topcoat slurry, which comprises an aqueous medium and water-insoluble inorganic particulate material comprising: (i) at least one oxide or silicate of a valve metal; (ii) optionally clay mineral; and (iii) optionally hydrous oxide of at least one of the metals zirconium and magnesium. The water-insoluble inorganic particulate material of the topcoat and topcoat slurry may comprise (i) alone; (i) and (ii); (i) and (iii); or (i), (ii) and (iii). The topcoat slurry may be drawn through the base mat while the base mat is still wet or after the base mat has been dried.

Examples of valve metal oxides and valve metal silicates that may be used in the diaphragm topcoat slurry include those recited previously herein with regard to the water-insoluble inorganic particulate materials added to the anolyte compartment. Preferred valve metal oxides and silicates include zirconium oxide and zirconium silicate. The clay mineral (ii) of the topcoat slurry may be selected from those classes of clay minerals as recited previously herein with regard to the water-insoluble inorganic particulate materials added to the anolyte compartment. Preferably, the clay mineral (ii) of the topcoat slurry is selected from attapulgite clays. The hydrous oxide (iii) of the topcoat slurry is preferably magnesium hydroxide.

When used in combination with clay mineral (ii) and or hydrous oxide of at least one of the metals zirconium and magnesium (iii), the valve metal-oxide/silicate (i) is present in the topcoat slurry in an amount of from 50 percent by weight to 98 percent by weight, preferably from 60 percent by weight to 90 percent by weight, and more preferably from 70 percent by weight to 85 percent by weight, based on the total dry weight of (i), (ii) and (iii). When present in the topcoat slurry, the clay mineral (ii) is typically present in an amount of from 1 percent by weight to 45 percent by weight, preferably from 5 percent by weight to 30 percent by weight, and more preferably from 10 percent by weight to 20 percent by weight, based on the total weight dry of (i), (ii) and (iii). When present in the topcoat slurry, the hydrous oxide of at least one of the metals zirconium and magnesium (iii) is typically present in an amount of from 1 percent by weight to 45 percent by weight, preferably from 3 percent by weight to 25 percent by weight, and more preferably from 5 percent by weight to 15 percent by weight, based on the total dry weight of (i), (ii) and (iii).

The amount of inorganic particulate material present in the liquid topcoat slurry that is drawn through the diaphragm base mat can vary over a wide range, depending on, for example, how much inorganic material is desired to be deposited on and within the base mat. Typically, the slurry contains inorganic material present in an amount of from 1 to 15 grams per liter of aqueous medium (gpl), e.g., 1 to 10 gpl or 3 to 5 gpl. The density of inorganic material deposited on and within the base mat is typically from 0.01 to 0.1 pounds per square foot (0.05 to 0.5 kg/square meter), e.g., 0.05 pounds per square foot (0.24 kg/square meter).

The aqueous medium of the topcoat slurry used in the preparation of the non-asbestos diaphragm may contain a wetting amount of organic surfactant selected from the group consisting of nonionic, anionic and amphoteric surfactants and mixtures thereof. If used, the organic surfactant is typically present in the aqueous medium of the topcoat slurry in an amount of from 0.01 percent by weight to 1 percent by weight, based on the total weight of the water comprising the aqueous medium, e.g., from 0.02 percent by weight to 0.5 percent by weight, based on the total weight of the water comprising the aqueous medium.

Examples of nonionic, anionic and amphoteric surfactants from which the organic surfactant of the diaphragm topcoat slurry may be selected include those that are known to the skilled artisan. Nonionic surfactants that may be used in the topcoat slurry include homopolymeric, random copolymeric and block copolymeric polyethers having terminal groups selected from, for example, hydroxyl, alkyl, halide, $C_1$–$C_5$ alkoxy, benzyloxy, phenoxy, phenyl ($C_1$–$C_3$)alkoxy, carbo acid groups, alkyl esters of carboxylic acid groups, sulfate, sulfanate and phosphate. An example of a commercially available class of nonionic surfactants that may be used in the topcoat slurry are the PLURONIC® surfactants available from BASF Corporation.

Anionic surfactants that may be used in the topcoat slurry include homopolymeric, random copolymeric and block copolymeric polyethers having terminal groups selected from, for example, alkali metal, ammonium or alkanolamine salts of carboxylates, sulfates, sultanates and phosphates. Nonionic and anionic surfactants that may be used in the topcoat slurry are described in further detail in U.S. Pat. No. 5,612,089 at column 3, line 15 through column 4, line 23, which disclosure is incorporated herein by reference.

Amphoteric surfactants that may be present in the topcoat slurry used in the preparation of the asbestos-free diaphragm typically have both acidic and basic hydrophilic moieties in the surfactant structure. Classes of amphoteric surfactants that may be used include, but are not limited to derivatives of imidazoline, betaines and derivatives of betaines, e.g., sulfobetaines. Amphoteric surfactants that may be present in the topcoat slurry are described in further detail in U.S. Pat. No. 5,612,089 at column 4, lines 24 through 55, which disclosure is incorporated herein by reference. Additional examples of nonionic, anionic and amphoteric surfactants (and their commercial sources) that may be used in the topcoat slurry can be found listed in the publication, *McCutcheon's Emulsifiers and Detergents*, Volume 1, MC Publishing Co., McCutcheon Division, Glen Rock, N.J.

The aqueous medium of the topcoat slurry used in the preparation of the non-asbestos diaphragm may contain alkali metal halide and/or alkali metal hydroxide. When the aqueous medium of the topcoat slurry contains a wetting amount of organic surfactant, the aqueous medium is preferably substantially free of both alkali metal halide and alkali metal hydroxide. By "substantially free" is meant that the alkali metal halide and alkali metal hydroxide are present in amounts less than that which would interfere with the effectiveness of the wetting amount of surfactant (e.g., present in amounts less than 5 percent or 1 percent by weight, based on the total weight of the aqueous medium). Preferably, the aqueous medium of the topcoat slurry contains neither alkali metal halide nor alkali metal hydroxide when an organic surfactant is present.

The fibrous synthetic polymeric material of the base mat of asbestos-free diaphragm may be fabricated from any organic polymer, copolymer, graft polymer or combination thereof which is substantially chemically and mechanically resistant to the operating conditions in which the diaphragm is employed, e.g., chemically resistant to degradation by exposure to electrolytic cell chemicals, such as sodium hydroxide, chlorine and hydrochloric acid. Such polymers are typically the halogen-containing polymers that include fluorine. Examples of such halogen-containing polymers include, but are not limited to, fluorine-containing or fluorine- and chlorine- containing polymers, such as polyvinyl fluoride, polyvinylidene fluoride, polytetrafluoroethylene (PTFE), polyperfluoro(ethylene-propylene), polytrifluoroethylene, polyfluoroalkoxyethylene (PFA polymer), polychlorotrifluoroethylene (PCTFE polymer) and the copolymer of chlorotrifluoroethylene and ethylene (CTFE polymer). Of the halogen-containing polymers, polytetrafluoroethylene is preferred.

The organic polymer of the asbestos-free diaphragm base mat is typically used in particulate form, e.g., in the form of particulates or fibers, as is well known in the art. In the form of fibers, the organic polymer material generally has a fiber length of up to about 0.75 inch (1.91 cm) and a diameter of from about 1 to 250 microns. Polymer fibers comprising the diaphragm base mat may be of any suitable denier that is commercially available. A typical PTFE fiber used to prepare asbestos-free diaphragm base mat is a ¼ inch (0.64 cm) chopped 6.6 denier fiber; however, other lengths and fibers of smaller or larger deniers may be used.

Organic polymeric materials in the form of microfibrils are also commonly used to prepare asbestos-free synthetic diaphragms. Such microfibrils may be prepared in accordance with the methods described in U.S. Pat. No. 5,030,403, the disclosure of which is incorporated herein by reference. The fibers and microfibrils of the organic polymeric material, e.g., PTFE fibers and microfibrils, comprise the predominant portion of the diaphragm solids.

An important property of the asbestos-free synthetic diaphragm is its ability to wick (wet) the aqueous alkali metal halide brine solution which percolates through the diaphragm. To provide the property of wettability, asbestos-free diaphragms that are useful in the present invention, and in particular, the diaphragm base mat, typically further comprise perfluorinated ion-exchange materials having sulfonic or carboxylic acid functional groups. When present, the ion-exchange material is typically present in the diaphragm base mat in an amount of from 0.5 to about 2 percent by weight, based on the total dried weight of the diaphragm base mat.

A preferred ion-exchange material is a perfluorinated material prepared as an organic copolymer from the polymerization of a fluoro vinyl ether monomer containing a functional group, i.e., an ion-exchange group or a functional group easily converted into an ion-exchange group, and a monomer chosen from the group of fluorovinyl compounds, such as vinyl fluoride, vinylidene fluoride, trifluoroethylene, tetrafluoroethylene, hexafluoroethylene, hexafluoropropylene, chlorotrifluoroethylene and perfluoro (alkylvinyl ether) with the alkyl being an alkyl group containing from 1 to 10 carbon atoms. A description of such ion-exchange materials can be found in U.S. Pat. No. 4,680,101 in column 5, line 36, through column 6, line 2, which disclosure is incorporated herein by reference.

An ion-exchange material with sulfonic acid functionality is particularly preferred. A perfluorosulfonic acid ion-exchange material (5 weight percent solution) is available from E. I. du Pont de Nemours and Company under the tradename NAFION resin. Other appropriate ion-exchange materials may be used to allow the diaphragm to be wetted by the aqueous brine fed to the electrolytic cell, as for example, the ion-exchange material available from Asahi Glass Company, Ltd. under the tradename FLEMION.

In addition to the aforedescribed fibers and microfibrils of halogen-containing polymers and the perfluorinated ion-exchange materials, the formulation used to prepare the diaphragm base mat may also include other additives, such as thickeners, surfactants, antifoaming agents, antimicrobial solutions and other polymers. In addition, materials such as fiberglass may also be incorporated into the diaphragm. An example of the components of a synthetic diaphragm material useful in a chlor-alkali electrolytic cell maybe found in Example 1 of U.S. Pat. No. 5,188,712,which disclosure is incorporated herein by reference.

The base mat of the liquid-permeable asbestos-free diaphragm that may be used in the electrolytic cell in the method of the present invention is commonly prepared by depositing the components thereof onto a permeable substrate, e.g., a foraminous metal cathode, from an base mat aqueous slurry. Typically, the components of the diaphragm base mat will be made up as a slurry in a liquid medium, such as water. The slurry used to deposit the base mat typically comprises from about 1 to about 6 weight percent solids, e.g., from about 1.5 to about 3.5 weight percent solids of the diaphragm components in the slurry, and has a pH of between about 8 and 10. The appropriate pH may be obtained by the addition of alkali metal hydroxide, e.g., sodium hydroxide, to the slurry.

The amount of each of the components comprising the diaphragm base mat may vary in accordance with variations known to those skilled in the art. For purposes of illustration, a base mat slurry that may be used in the preparation of a liquid-permeable asbestos-free diaphragm typically has a weight percent solids of between 1 and 6 weight percent, and the following approximate amounts of components (as percentages by weight, based on the total weight of the base mat slurry): polyfluorocarbon fibers, e.g., PTFE fibers, from 0.25 to 1.5 percent; polyfluorocarbon microfibrils, e.g., PTFE microfibrils, from 0.6 to about 3.8 percent; ion-exchange material, e.g., NAFION resin, from about 0.01 to about 0.05 weight percent; fiberglass, from about 0.06 to about 0.4 percent; and polyolefin, e.g., polyethylene, such as SHORT STUFF, from about 1.06 to about 0.3 percent. All of the aforementioned percentages are weight percentages and are based on the total weight of the base mat slurry.

The aqueous base mat slurry comprising the asbestos-free diaphragm base mat components may also contain a viscosity modifier or thickening agent to assist in the dispersion of the solids, e.g., the perfluorinated polymeric materials in the slurry. For example, a thickening agent such as CELLOSIZE® materials may be used. Generally, from about 0.1 to about 5 percent by weight of the thickening agent can be added to the slurry mixture, basis the total weight of the slurry, more preferably from about 0.1 to about 2 percent by weight thickening agent.

A surfactant may also be added to the aqueous base mat slurry of asbestos-free diaphragm base mat components to assist in obtaining an appropriate dispersion. Typically, the surfactant is a nonionic surfactant and is used in amounts of from about 0.1 to about 3 percent, more preferably from about 0.1 to about 1 percent, by weight, basis the total weight of the slurry. Particularly contemplated nonionic surfactants are chloride capped ethoxylated aliphatic alcohols, wherein the hydrophobic portion of the surfactant is a hydrocarbon group containing from 8 to 15, e.g., 12 to 15, carbon atoms, and the average number of ethoxylate groups ranges from about 5 to 15, e.g., 9 to 10. An example of such nonionic surfactant is AVANEL® N-925 surfactant (a product of BASF Corporation).

Other additives that may be incorporated into the aqueous base mat slurry include antifoaming amounts of an antifoaming agent, such as UCON® LO-500 antifoaming compound (a product of Union Carbide Corp.), to prevent the generation of excessive foam during mixing of the slurry, and an antimicrobial agent to prevent the digestion of the cellulose-based components by microbes during storage of the slurry. An appropriate antimicrobial is UCARCIDE® 250, which is available from Union Carbide Corporation. Other antimicrobial agents known to those skilled in the art may be used. Antimicrobials may be incorporated into the base mat slurry in amounts of from about 0.05 to about 0.5 percent by weight, e.g., between about 0.08 and about 0.2 weight percent.

The diaphragm base mat may be deposited from a base mat slurry of diaphragm base mat components directly upon a liquid permeable solid substrate, for example, a foraminous cathode, by vacuum deposition, pressure deposition, combinations of such deposition techniques or other techniques known to those skilled in the art. The liquid permeable substrate, e.g., foraminous cathode, is immersed into the base mat slurry which has been well agitated to insure a substantially uniform dispersion of the diaphragm components, and the slurry drawn through the liquid permeable substrate, thereby to deposit the components of the diaphragm as a base mat onto the substrate. The liquid permeable substrate is withdrawn from the base mat slurry, usually with the vacuum still applied to insure adhesion of the diaphragm base mat to the substrate and assist in the removal of excess liquid from the diaphragm mat. The deposited base mat may be dried and then topcoated with the topcoat slurry as described previously herein, or the base mat drying step may be skipped.

The base mat of the liquid-permeable asbestos-free diaphragm typically has a weight density of from about 0.35 to about 0.55 pounds per square foot (1.71–2.68 kg/square meter), more typically from about 0.38 to about 0.42 pounds per square foot (1.85–2.05 kg/square meter). The diaphragm base mat will generally have a thickness of from about 0.075 to about 0.25 inches (0.19–0.64 cm), more usually from about 0.1 to about 0.15 inches (0.25–0.38 cm). The preparation of liquid-permeable asbestos-free diaphragms that are particularly useful in the present invention are described in further detail in U.S. patent application Ser. No. 09/124,441 (and now U.S. Pat. No. 6,059,944), the disclosure of which is incorporated herein by reference in its entirety.

Electrolytic cells that are useful in the method of the present invention are known to those of ordinary skill in the chlor-alkali art, and are fabricated from materials or combinations of materials that are resistant to the operating environment of the cell, e.g., stainless steal, titanium and fluorinated polymers, such as polytetrafluoroethylene. The cathode of the cell is typically fabricated of iron, iron alloy or some other metal resistant to the operating chloralkali electrolytic cell environment to which it is exposed, for example, nickel or mild steel. The cathode is typically in the form of a metal mesh, expanded metal mesh, perforated plate, perforated sheet, woven screen, metal rods or the like. The anode of the cell is typically fabricated from titanium mesh coated with ruthenium oxide and titanium oxide.

The diaphragm of the electrolytic cell is typically positioned in an abutting relationship with the cathode. If the diaphragm is topcoated, the uncoated side of the diaphragm is typically positioned in an abutting relationship with the cathode. The alkali metal chloride brine that is fed to the anolyte compartment of the cell is typically a sodium chloride brine, a potassium chloride brine or a brine containing both sodium chloride and potassium brine. The alkali metal chloride brine typically contains alkali metal chloride in an amount of from 24 percent by weight to 26 percent by weight, based on the total weight of the brine.

EXAMPLES

The present invention is more particularly described in the examples that follow, which are intended to be illustrative only, since numerous modifications and variations therein will be apparent to those skilled in the art.

In the following examples, all reported percentages are weight percents, unless noted otherwise or unless indicated as otherwise from the context of their use. The current efficiencies of the laboratory chlor-alkali electrolytic cells are "caustic efficiencies," which are calculated by comparing the amount of sodium hydroxide collected over a given time period with the theoretical amount of sodium hydroxide that would be generated applying Faraday's Law. Unless otherwise noted, the term "sodium chloride brine" as used in the following examples refers to an aqueous brine containing 25 percent by weight of sodium chloride, based on the total weight of brine. The day following the day in which each electrolytic cell was started up is referred to as the first day or day 1 of cell operation, in each of the following examples.

Laboratory chlor-alkali electrolytic cells constructed of TEFLON polytetrafluoroethylene, and having an active electrode area of 9 square inches (58 square cm) were used in the following examples. The catholyte and anolyte compartments of each electrolytic cell each had a volume of 130 milliliters (ml). A ruthenium oxide coated titanium mesh electrode (obtained from Electrode Corporate and having the designation "EC-200") was used as the anode, and a woven mild steel 6 mesh screen electrode was used as the cathode. The cathode and anode were separated by a distance of approximately 3/16 inch (0.48 cm). The uncoated side of a topcoated liquid permeable asbestos-free diaphragm was positioned in an abutting relationship with the cathode, and separated the catholyte and anolyte compartments of each cell.

The liquid permeable asbestos-free diaphragm used in each cell was composed of a base-mat of polytetrafluoroethylene fibers, having a coating of zirconium oxide, attapulgite clay and magnesium oxide applied to one side. The base-mat of the diaphragm was prepared from an aqueous base-mat slurry of approximately the following weight percent composition, based on the total weight of the base-mat aqueous slurry:

- 0.33 percent by weight of CELLOSIZE ER-52M hydroxyethyl cellulose (product of Union Carbide Corp.);
- 0.10 percent by weight of 1 Normal sodium hydroxide solution;
- 0.54 percent by weight of AVANEL® N-925 nonionic surfactant (product of BASF Corporation);
- 0.06 percent by weight of UCARCIDE-250 biocide (50 weight percent aqueous glutaraldehyde antimicrobial solution, product of Union Carbide Corp.);
- 0.62 percent by weight of ¼ inch (0.64 cm) chopped 6.67 denier TEFLON polytetrafluoroethylene floc (product of E.I. DuPont deNemours & Co.);
- 0.12 percent by weight of chopped PPG DE fiberglass (product of PPG Industries, Inc.);
- 0.14 percent by weight of SHORT STUFF GA-844 polyethylene fiber (product of Minifibers Corp.);
- 1.57 percent by weight of TEFLON 60 polytetrafluoroethylene (PTFE) microfibrils having a length of 0.2–0.5 mm and a diameter of 10–15 microns, prepared in accordance with the procedure described in U.S. Pat. No. 5,030,403;
- 0.02 perfluorosulfonic acid ion exchange material (product of E.I. DuPont deNemours & Co.); and the balance, water.

The diaphragm base-mat was deposited on a 4 inch×18 inch (10.2 cm×45.7 cm) woven mild steel 6 mesh screen by drawing a portion of the described base-mat slurry through the screen under vacuum. The vacuum was gradually increased from 1 inch (25 mm) of mercury to about 15–20 inches (381–508 mm) of mercury over a period of about 10–15 minutes. The vacuum was held at 15–20 inches (381–508 mm) of mercury as needed to filter the desired amount of base mat slurry through the screen (e.g., 2.5 liters of base mat slurry). The screen was then lifted from the slurry to allow the diaphragm to drain with the vacuum continued for an additional 30–60 minutes. While continuing to draw air through the diaphragm base-mat, the base-mat and underlying screen were both dried over a period of 4 hours at a temperature of 60° C.

The base-mat was coated with an aqueous topcoat slurry prepared by dispersing ZIROX® 120 zirconium oxide powder, ATTAGEL 50 attapulgite clay powder and magnesium hydroxide in a cumulative amount of 10 grams per liter (gpl) into de-ionized water containing 1 gpl of AVANEL® N-925 (90%) nonionic surfactant. The topcoat slurry contained 77.5 percent by weight of ZIROX® 120 zirconium oxide powder, 15 percent by weight of ATTAGEL 50 attapulgite clay powder, and 7.5 percent by weight of magnesium hydroxide, percent weights being based on the total weight of zirconium oxide, clay and magnesium hydroxide.

The dried diaphragm base mat was topcoated by drawing the topcoat slurry under vacuum through the diaphragm base-mat. The vacuum during topcoating was increased and held at 21 inches (533 mm) of mercury until the screen was removed from the topcoat slurry at about 10 minutes. The diaphragm was then placed in a 60° C. oven for 4 hours. A water aspirator was used to maintain air flow through the diaphragm while it was in the oven. The topcoat weight density was estimated to be 0.049 lb./ft$^2$ (0.24 kg/m$^2$) (dry basis) from the measured increase in dry weight before and after topcoating of the base mat.

The total diaphragm weight density (diaphragm base mat 30 topcoat) after drying was 0.49 lb./ft$^2$ (2.40 kg/m$^2$). The resultant diaphragm upon being separated from the underlying screen was observed to be uniform in appearance, having no visually observable indication of surface defects, such as mud-cracking. The topcoated diaphragm was cut into 4 inch×4 inch (10 cm×10 cm) squares for use in the laboratory chloralkali cells of the following examples.

Example 1

This example describes the comparative operation of a laboratory chlor-alkali electrolytic cell as described previously herein, in which a slurry of clay and sodium chloride brine was added periodically to the anolyte compartment of the cell during its operation. Prior to start-up, deionized water was flushed through the cell for a period of about 16 hours. The deionized water was then drained from the cell, and sodium chloride brine having a pH of 5.5 was fed to the anolyte compartment at a rate of 3 ml per minute for a period of less than 24 hours, followed by a rate of 2 ml per minute for the duration of cell operation. The cell was operated continuously for 36 days at a temperature of 194° F. (90° C.) and a current setting of 90 amperes {144 amperes/ft$^2$(ASF)}.

Upon start-up of the cell, a slurry of 0.5 grams of ATTAGEL 50 attapulgite clay powder and 100 ml of sodium chloride brine was added to the anolyte compartment of the cell. A slurry of 0.3 grams of ATTAGEL 50 attapulgite clay powder and 100 ml of sodium chloride brine was added to the anolyte compartment of the cell on each of the following days of continuous cell operation, days 2, 7, 8, 9, 10, 15, 16, 17, 20, and 21. The clay and sodium chloride brine slurries were prepared by adding the indicated amount of clay to 100 ml of sodium chloride brine with agitation provide by a magnetic stir bar.

Based on the collection of current efficiency data, the cell was observed to reach steady state operation on about the 16$^{th}$ day of operation. From day 16 through day 36 of operation, the cell was found to have: an average current efficiency of 95.3 percent±0.4 percent; an average anolyte level of 2.9 inches±0.4 inches (7.4 cm±1 cm) above the liquid level of the catholyte compartment; an average sodium hydroxide production of 116 gpl±2 gpl; an average cell voltage of 2.98 volts±0.02 volts; and an average power consumption of 2144 DC kilowatt hours/ton of chlorine produced (KWH/T chlorine)±19 KWH/T chlorine.

Example 2

This example describes the comparative operation of a laboratory chlor-alkali electrolytic cell similar to that described in Example 1, in which a slurry of clay, magnesium hydroxide and sodium chloride brine was added periodically to the anolyte compartment of the cell (with subsequent reduction of the anolyte pH to 2) during operation of the cell. The cell was started up as described in Example 1, and sodium chloride brine having a pH of 5.5 was fed to the anolyte compartment at a rate of 3 ml per minute for a period of less than 24 hours, followed by a rate of 2 ml per minute for the duration of cell operation. The cell was operated continuously for 37 days at a temperature of 194° F. (90° C.) and a current setting of 90 amperes {144 amperes/ft$^2$ (ASF)}.

A slurry of 0.2 grams of ATTAGEL 50 attapulgite clay powder, 0.2 grams of magnesium hydroxide and about 100 ml of sodium chloride brine was added to the anolyte compartment at cell start-up and on each of the following days of continuous cell operation, days 1, 2, 7, 8, 9 and 21. After each addition of the described slurry, the pH of the anolyte was reduced to 2 with the further addition of aqueous hydrochloric acid. The slurries were prepared by adding the indicated amounts of clay and magnesium hydroxide to about 100 ml of sodium chloride brine with agitation provided by a magnetic stir bar.

Based on the collection of current efficiency data, the cell was observed to reach steady state operation on about the 10$^{th}$ day of operation. From day 10 through day 37 of operation, the cell was found to have: an average current efficiency of 97.0 percent±0.4 percent; an average anolyte level of 11.8 inches±0.9 inches (30.0 cm±2.3 cm) above the liquid level of the catholyte compartment; an average sodium hydroxide production of 117 gpl±2.7 gpl; an average cell voltage of 3.05 volts±0.03 volts; and an average power consumption of 2156 KWH/T chlorine±29 KWH/T chlorine.

Example 3

This example describes the operation in accordance with the present invention of a laboratory chlor-alkali electrolytic cell similar to that described in Example 1. A doping slurry of clay, tetrasodium pyrophosphate decahydrate and sodium chloride brine were added to the anolyte compartment of the cell during its operation. The cell was started up as described in Example 1, and sodium chloride brine having a pH of 5.5 was fed to the anolyte compartment at a rate of 3 ml per minute for a period of less than 24 hours, followed by a rate of 2 ml per minute for the duration of cell operation. The cell was operated continuously for 30 days at a temperature of 194° F. (90° C.) and a current setting of 90 amperes {144 amperes/ft$^2$ (ASF)}.

The doping slurries of clay, tetrasodium pyrophosphate decahydrate and sodium chloride brine used in the present example were prepared by first mixing the indicated amount of tetrasodium pyrophosphate decahydrate with 50 ml of deionized water, with agitation provided by a magnetic stir bar. The indicated amount of ATTAGEL 50 attapulgite clay powder was then added to the mixture of water and tetrasodium pyrophosphate decahydrate. Between 50 ml to 100 ml of warm sodium chloride brine (having a temperature of from 60 to 70° C.) was then added to the mixture of deionized water, tetrasodium pyrophosphate decahydrate and clay to form the doping slurry that was added to the anolyte compartment of the cell.

Upon start-up of the cell, a doping slurry of 0.5 grams of ATTAGEL 50 attapulgite clay powder and 0.4 grams of tetrasodium pyrophosphate decahydrate in deionized water and sodium chloride brine was added to the anolyte compartment of the cell. A doping slurry of 0.3 grams of ATTAGEL 50 attapulgite clay powder and 0.3 grams of tetrasodium pyrophosphate decahydrate in deionized water and sodium chloride brine was added to the anolyte compartment of the cell on each of the following days of continuous cell operation, days 1, 6, 7, 8, 9, 14, 15, 16, 19 and 20.

Based on the collection of current efficiency data, the cell was observed to reach steady state operation on about the 15th day of operation. From day 15 through day 30 of operation, the cell was found to have: an average current efficiency of 97.0 percent±0.3 percent; an average anolyte level of 9.4 inches±2.2 inches (23.9 cm±5.6 cm) above the liquid level of the catholyte compartment; an average sodium hydroxide production of 115 gpl±1.5 gpl; an average cell voltage of 2.94 volts±0.03 volts; and an average power consumption of 2078 KWH/T chlorine±24 KWH/T chlorine.

The examples show that a chlor-alkali electrolytic cell operated in accordance with the method of the present invention, e.g., as described in Example 3,has a caustic efficiency equal to or greater than that of a cell operated under comparative methods, e.g., as described in Examples 1 and 2. In addition, an electrolytic cell operated in accordance with the present invention, e.g., as described in Example 3,has a power consumption less than that of a cell operated under comparative methods, e.g., as described in Examples 1 and 2.

The present invention has been described with reference to specific details of particular embodiments thereof. It is not intended that such details be regarded as limitations upon the scope of the invention except insofar as and to the extent that they are included in the accompanying claims.

We claim:

1. A method of operating an electrolytic cell comprising:

(a) providing an electrolytic cell having a catholyte compartment containing a cathode, an anolyte compartment containing an anode, and a liquid-permeable diaphragm separating said catholyte and anolyte compartments;

(b) introducing alkali metal chloride brine into said anolyte compartment;

(c) applying an electrical potential across said cathode and anode; and (d) withdrawing hydrogen gas and an aqueous solution comprising alkali metal hydroxide from said catholyte compartment, and chlorine gas from said anolyte compartment; wherein the improvement comprises adding water-insoluble inorganic particulate material and alkali metal polyphosphate to said anolyte compartment while said electrolytic cell is operating.

2. The method of claim 1 wherein said inorganic particulate material is selected from valve metal oxides, valve metal silicates, clay mineral and mixtures thereof.

3. The method of claim 2 wherein said inorganic particulate material is clay mineral selected from kaolin minerals, montmorillonite minerals, illite minerals, glauconite, sepiolite and mixtures thereof.

4. The method of claim 3 wherein the clay mineral is attapulgite clay.

5. The method of claim 1 wherein from 10 grams to 120 grams of water-insoluble inorganic particulate material per square meter of diaphragm surface area, and from 1 gram to 60 grams of alkali metal polyphosphate per square meter of diaphragm surface area, are added to said anolyte compartment.

6. The method of claim 1 wherein said alkali metal polyphosphate is selected from tetraalkali metal pyrophosphate, alkali metal triphosphate, alkali metal tetraphosphate, alkali metal hexametaphosphate and mixtures thereof.

7. The method of claim 6 wherein said alkali metal polyphospahte is tetrasodium pyrophosphate.

8. The method of claim 1 wherein the water-insoluble inorganic particulate material and alkali metal polyphosphate are premixed together with an aqueous medium to form an aqueous doping slurry, said aqueous doping slurry is added to said anolyte compartment.

9. The method of claim 8 wherein said aqueous medium of said doping slurry comprises alkali metal chloride.

10. The method of claim 1 wherein said liquid-permeable diaphragm is a liquid-permeable asbestos-free diaphragm.

11. The method of claim 10 wherein said liquid-permeable asbestos-free diaphragm comprises (a) a base mat of asbestos-free material comprising fibrous synthetic polymeric material resistant to the environment of said electrolytic cell, and (b) a topcoat formed on and within said diaphragm base mat by drawing through said diaphragm base mat a liquid topcoat slurry comprising an aqueous medium and water-insoluble inorganic particulate material comprising, (i) at least one oxide or silicate of a valve metal, (ii) optionally clay mineral, and (iii) optionally hydrous oxide of at least one of the metals zirconium and magnesium.

12. The method of claim 11 wherein said diaphragm base mat further comprises ion-exchange material; the fibrous synthetic polymeric material of said base mat comprises perfluorinated polymeric material; the aqueous medium of said liquid topcoat slurry contains a wetting amount of organic surfactant selected from the group consisting of nonionic, anionic and amphoteric surfactants, and mixtures of said surfactants; and the aqueous medium of said topcoat slurry is substantially free of alkali metal halide and alkali metal hydroxide.

13. The method of claim 12 wherein a combination of the inorganic particulate materials (i), (ii) and (iii) are present in the liquid topcoat slurry, (i) is zirconium oxide, the clay mineral (ii) is selected from kaolin minerals, montmorillonite minerals, illite minerals, glauconite sepiolite and mixtures thereof, and (iii) is magnesium hydroxide.

14. A method of operating an electrolytic cell comprising:

(a) providing an electrolytic cell having a catholyte compartment containing a cathode, an anolyte compartment containing an anode, and a liquid-permeable asbestos-free diaphragm separating said catholyte and anolyte compartments, said diaphragm comprising a base mat of asbestos-free material comprising fibrous synthetic polymeric material resistant to the environment of said electrolytic cell, and a topcoat comprising water-insoluble inorganic particulate material comprising, (i) at least one oxide or silicate of a valve metal, (ii) optionally clay mineral, and (iii) optionally hydrous oxide of at least one of the metals zirconium and magnesium;

(b) introducing alkali metal chloride brine into said anolyte compartment;

(c) applying an electrical potential across said cathode and anode; and (d) withdrawing hydrogen gas and an aqueous solution comprising alkali metal hydroxide from said catholyte compartment, and chlorine gas from said anolyte compartment; wherein the improvement comprises adding clay mineral and alkali metal polyphosphate to said anolyte compartment while said electrolytic cell is operating.

15. The method of claim 14 wherein the clay mineral of said topcoat and the clay mineral added to said anolyte compartment are each independently selected from kaolin minerals, montmorillonite minerals, illite minerals, glauconite, sepiolite and mixtures thereof.

16. The method of claim 15 wherein the clay mineral added to said anolyte compartment is attapulgite clay, and said alkali metal polyphosphate is selected from tetraalkali metal pyrophosphate, alkali metal triphosphate, alkali metal tetraphosphate, alkali metal hexametaphosphate and mixtures thereof.

17. The method of claim 16 wherein the clay mineral and alkali metal polyphosphate are premixed together with an aqueous medium to form an aqueous doping slurry, said aqueous doping slurry is added to said anolyte compartment.

18. The method of claim 17 wherein said alkali metal polyphosphate is tetrasodium pyrophosphate.

19. The method of claim 18 wherein from 10 grams to 120 grams of clay mineral per square meter of diaphragm surface area, and from 1 gram to 60 grams of alkali metal polyphosphate per square meter of diaphragm surface area, are added to said anolyte compartment; and the aqueous medium of said doping slurry comprises alkali metal chloride.

20. The method of claim 19 wherein said liquid-permeable diaphragm base mat further comprises ion-exchange material; and the fibrous synthetic polymeric material of said base mat comprises perfluorinated polymeric material.

21. The method of claim 20 wherein said topcoat is formed on and within said diaphragm base mat by drawing through said diaphragm base mat a liquid topcoat slurry comprising an aqueous medium and said water-insoluble inorganic particulate material; the aqueous medium of said liquid topcoat slurry contains a wetting amount of organic surfactant selected from the group consisting of nonionic, anionic and amphoteric surfactants, and mixtures of said surfactants; and the aqueous medium of said topcoat slurry is substantially free of alkali metal halide and alkali metal hydroxide.

22. The method of claim 21 wherein a combination of the inorganic particulate materials (i), (ii) and (iii) are present in the liquid topcoat slurry, (i) is zirconium oxide, the clay mineral (ii) is attapulgite clay, and (iii) is magnesium hydroxide.

* * * * *